US009556610B2

(12) United States Patent
Pozza et al.

(10) Patent No.: US 9,556,610 B2
(45) Date of Patent: Jan. 31, 2017

(54) WALL BASE STRUCTURE FOR LIGHT BUILDINGS

(71) Applicants: UNIVERSITA' DEGLI STUDI DI PADOVA, Padua (IT); Luca Pozza, Villaga (IT)

(72) Inventors: Luca Pozza, Villaga (IT); Roberto Scotta, Preganziol (IT)

(73) Assignees: UNIVERSITA' DEGLI STUDI DI PADOVA, Padua (IT); Luca Pozza, Villaga (IT)

( * ) Notice: Subject to any disclaimer, the term of this patent is extended or adjusted under 35 U.S.C. 154(b) by 0 days.

(21) Appl. No.: 14/443,971

(22) PCT Filed: Nov. 19, 2012

(86) PCT No.: PCT/IB2012/056544

§ 371 (c)(1),
(2) Date: May 19, 2015

(87) PCT Pub. No.: WO2014/076526

PCT Pub. Date: May 22, 2014

(65) Prior Publication Data

US 2015/0284948 A1 Oct. 8, 2015

(51) Int. Cl.
*E02D 27/00* (2006.01)
*E04B 2/72* (2006.01)
(Continued)

(52) U.S. Cl.
CPC ..... *E04B 2/721* (2013.01); *E02D 27/00* (2013.01); *E04B 1/08* (2013.01); *E04B 1/10* (2013.01);
(Continued)

(58) Field of Classification Search
CPC ..... E04B 2/721; E04B 1/40; E04B 1/10; E04B 1/08; E04B 2001/405; E04B 2001/2463; E04B 2/82; E04B 2001/268; E02D 27/00
(Continued)

(56) References Cited

U.S. PATENT DOCUMENTS 2,372,768 A * 4/1945 Davison ..... E04B 1/26 52/289
3,641,720 A * 2/1972 Berrie ..... E04B 1/14 52/126.4
(Continued)

FOREIGN PATENT DOCUMENTS

DE 3200262 A1 7/1983
EP 0428962 A2 5/1991

*Primary Examiner* — Basil Katcheves
*Assistant Examiner* — Joshua Ihezie
(74) *Attorney, Agent, or Firm* — Hedman & Costigan, P.C.; James V. Costigan; Kathleen A. Costigan

(57) ABSTRACT

A base (1*a*, 1*b*, 1*c*) for building wall (10*a*, 10*b*, 10*c*) comprising:

a base socle (3*a*, 3*b*, 3*c*) interposed, in position, between a panel (2) of the wall (10*a*, 10*b*, 10*c*) and a foundation slab, a tubular member (5) filled with a mixture (6) including cement and water interposed, in position, between the base socle (3*a*, 3*b*, 3*c*) and the foundation slab, first constraint means (7*a*, 7*c*, 8, 9, 11) to rigidly constrain, in position, the base socle (3*a*, 3*b*, 3*c*) to the foundation slab; the planimetric position of the base socle (3*a*, 3*b*, 3*c*) and its distance from the foundation slab being adjustable by means of said first constraint means (7*a*, 7*c*, 8, 9, 11), second constraint means (7*a*, 7*b*, 7*c*, 12, 13) to rigidly constrain, in position, said panel (2) to said base socle (3*a*, 3*b*, 3*c*).

15 Claims, 8 Drawing Sheets

(51) Int. Cl.

| | |
|---|---|
| ***E04B 1/08*** | (2006.01) |
| ***E04B 1/10*** | (2006.01) |
| ***E04B 1/41*** | (2006.01) |
| *E04B 2/82* | (2006.01) |
| *E04B 1/24* | (2006.01) |
| *E04B 1/26* | (2006.01) |
| *E04B 1/38* | (2006.01) |

(52) U.S. Cl.
CPC .. *E04B 1/40* (2013.01); *E04B 2/82* (2013.01); *E04B 2001/2463* (2013.01); *E04B 2001/268* (2013.01); *E04B 2001/405* (2013.01)

(58) Field of Classification Search
USPC ..... 52/293.1, 293.3, 295, 432, 704, 294
See application file for complete search history.

(56) References Cited

U.S. PATENT DOCUMENTS 3,707,817 A * 1/1973 Schmitt ..... B60P 3/36 52/220.1
3,842,554 A * 10/1974 Swick ..... E04B 2/94 52/235
4,176,504 A * 12/1979 Huggins ..... E04B 1/68 52/264
4,391,069 A * 7/1983 Vermillion ..... E04B 2/7433 52/126.4
4,530,194 A * 7/1985 Linton ..... E04B 1/30 403/219
4,630,418 A * 12/1986 Degut ..... E04B 1/10 52/264
4,884,376 A 12/1989 DeBlock
4,890,638 A * 1/1990 Davenport ..... E03B 7/095 137/377
4,914,879 A * 4/1990 Goldberg ..... E04B 1/14 52/242
5,207,042 A * 5/1993 Molinar ..... E04B 1/0007 52/274
5,399,050 A * 3/1995 Jacobus ..... E04F 17/00 249/13
5,467,570 A * 11/1995 Leek ..... E04B 1/2608 403/190
6,003,276 A * 12/1999 Hegemier ..... E04H 9/02 156/71
6,003,279 A * 12/1999 Schneider ..... E04B 1/0046 403/230
6,250,041 B1 * 6/2001 Seccombe ..... E04B 1/2604 403/190
6,260,320 B1 * 7/2001 Di Lorenzo ..... E04B 1/04 52/250
6,298,619 B1 * 10/2001 Davie ..... E04B 1/14 52/220.7
6,840,706 B1 * 1/2005 Camomilla ..... E01F 15/043 256/13.1
6,877,291 B2 * 4/2005 Shamroukh ..... E04B 7/022 403/232.1
6,911,076 B2 * 6/2005 Keshmiri ..... E04C 2/382 106/642
7,121,764 B2 * 10/2006 Rorheim ..... E02B 3/102 405/100
7,356,973 B2 * 4/2008 Roesset ..... E04B 1/2608 52/231
7,509,777 B2 * 3/2009 Nakaki ..... E04H 9/021 52/167.1
8,234,826 B1 * 8/2012 Proffitt, Jr. ..... E02D 27/00 52/293.3
8,387,321 B2 * 3/2013 diGirolamo ..... E04B 2/58 52/241
8,448,397 B2 * 5/2013 Tincher ..... E04B 1/4114 249/83
2003/0019175 A1 * 1/2003 Kremers ..... E02D 27/02 52/294
2004/0255551 A1 * 12/2004 Fuhr ..... E04B 5/10 52/782.1
2006/0213136 A1 * 9/2006 Lin ..... E04B 1/2604 52/295
2007/0251723 A1 * 11/2007 Duffy ..... A62C 3/16 174/483
2012/0085049 A1 * 4/2012 Schiffmann ..... E04B 1/0007 52/293.1

* cited by examiner

WALL BASE STRUCTURE FOR LIGHT BUILDINGS

FIELD OF THE INVENTION

The present invention relates to a base that is couplable to a building wall to connect said wall to a reinforced concrete foundation. The invention also relates to a building wall comprising said base and a building construction method comprising said wall. The present invention is particularly, albeit not exclusively, suitable for application to the construction of buildings having a light structure, for example comprising wooden or steel or aluminium walls.

BACKGROUND OF THE INVENTION

In the sector relating to the construction of temporary or permanent buildings having a light structure, reinforced concrete foundations are produced in the prior art to which the elevated parts of buildings are normally constrained by means of the use of angle or flat brackets and of the so-called "hold-downs".

There is a known difficulty, in particular in the case of elevated pre-fabricated structures, in producing concrete foundations with the required planimetric and altimetric laying precision. The greater the extension of the panels or walls constituting the elevated structure the greater said difficulty. The hold-downs and the brackets normally used in wooden constructions, respectively constrain the vertical and horizontal movements of the elevated structure with respect to the foundation, but do not allow any adjustment of the height and of the inclination with respect to the vertical direction of the wall, during the installation steps. Consequently, the required installation precision is only achievable with lengthy timeframes and high costs. The fact that the light elevated structure rests directly on the foundation also determines a plurality of energy-related drawbacks, such as heat losses and rising damp. This latter problem is particularly felt in the case of wooden buildings as the rising damp determines a quicker degradation of the elevated structure. To partially overcome this problem, a base wooden beam of wood base is produced in the prior art, with harder and more durable or suitably treated wood, interposed between the foundation and the building walls. Even this latter solution is not however optimal as a wooden base structure, the beam, is in any case placed in direct contact with the cement structure. A further drawback of the solution with wooden beam is determined in that the latter is subject to crushing by orthogonal compression to the fibres by effect of the weight of the elevated structure bearing thereon.

SUMMARY OF THE INVENTION

The main object of the present invention is thus that of providing a base for building walls that allows the above-reported drawbacks to be overcome with reference to the aforementioned prior art while achieving the following advantages:

- high-precision of both planimetric and altimetry application;
- quick and economic installation;
- effective insulation from the reinforced concrete foundation, so as to prevent both heat losses and rising damp;

A further object is that of providing a wall or pre-fabricated panel for the construction of buildings provided with a base constrainable to a reinforced concrete foundation capable of achieving the above-indicated advantages.

A further object is that of indicating a construction method for the construction of buildings comprising a plurality of walls or panels of the aforementioned type.

Said advantages can be achieved by means of a building wall base comprising:

- a base socle susceptible to being interposed, in position, between a panel of said building wall and a foundation slab,
- first constraint means to rigidly constrain, in position, said base socle to said foundation slab, said first constraint means being such as to allow adjustment of the position and inclination of said base socle with respect to said foundation slab,
- second constraint means to rigidly constrain, in position, said panel to said base socle.

Further advantages are achieved by means of an optional tubular member filled with a mixture consisting of cement grout or another material that is suitable and susceptible to being interposed, in position, between said base socle and said foundation slab.

Other advantages are achieved by means a building wall base of the above-indicated type and further comprising a thermally insulating layer susceptible to being interposed, in position, between said panel and said base socle.

According to a further aspect of the invention, the aforementioned problems are resolved by means of a building wall comprising a panel made of a light material and a base that include:

- a base socle susceptible to being interposed, in position, between said panel of said building wall and a foundation slab,
- first constraint means to rigidly constrain, in position, said base socle to said foundation slab, said first constraint means being such as to allow adjustment of the position and of the inclination of said base with respect to said foundation slab,
- second constraint means to rigidly constrain, in position, said panel to said base socle.

According to a third aspect of the invention, the same problems as indicated above are resolved by means of a building construction method comprising the steps of:

- preparing a foundation slab in reinforced concrete,
- placing a base socle onto the foundation slab and constraining said base to said foundation slab by means of first constraint means,
- adjusting the position and the inclination of said base socle with respect to said foundation slab by means of first constraint means, capable of allowing adjustment of the position and of the planimetric and altimetric alignment of the base
- placing a thermally insulating layer onto said base socle,
- placing a panel on said thermally insulating layer,
- rigidly constraining said panel to said base socle by means of second constraint means.

BRIEF DESCRIPTION OF THE DRAWINGS

Further characteristics and advantages of the invention will become clearer in the light of the detailed description of preferred but non-exclusive embodiments of a building wall base according to the present invention illustrated by way of a non-limiting example, with the assistance of the accompanying drawings, wherein.

DETAILED DESCRIPTION OF THE INVENTION

With reference to the accompanying drawings, three distinct embodiments of a building wall according to the present invention are respectively indicated by 10*a*, 10*b*, 10*c*.

Each of the building walls 10*a*, 10*b*, 10*c* includes a panel 2 and, respectively, a base 1*a*, 1*b*, 1*c* connecting the panel 2 and a foundation slab (not shown as not the object of this invention).

The panel 2 consists of a light prefabricated panel made of wood or steel or aluminium or other material.

According to other embodiments (not shown), the panel 2 is of another type, possibly consisting, for example, of a plurality of bricks or other types of members rigidly constrained to each other.

The foundation slab is made of reinforced concrete or other suitable material.

The building walls 10*a*, 10*b*, 10*c* differ from each other in the structure of the respective bases 1*a*, 1*b*, 1*c*. In the three embodiments 1*a*, 1*b*, 1*c* of the base, some of the components are structurally and functionally identical and shall therefore be indicated by the same numeric references in the following description and in the accompanying drawings.

Figure 1:
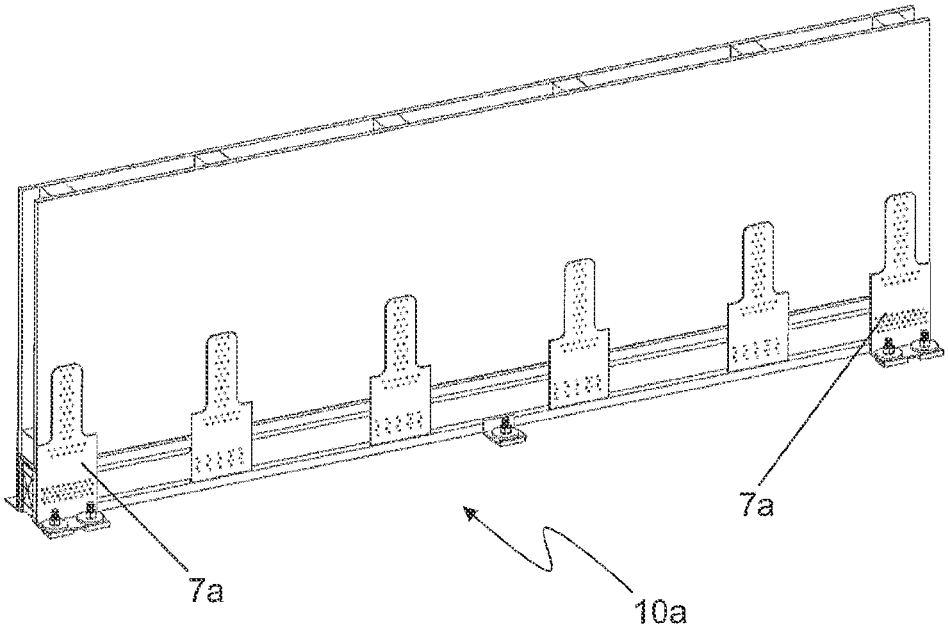
FIG. 1 is an axonometric view of a building wall according to the present invention.
Figure 4:
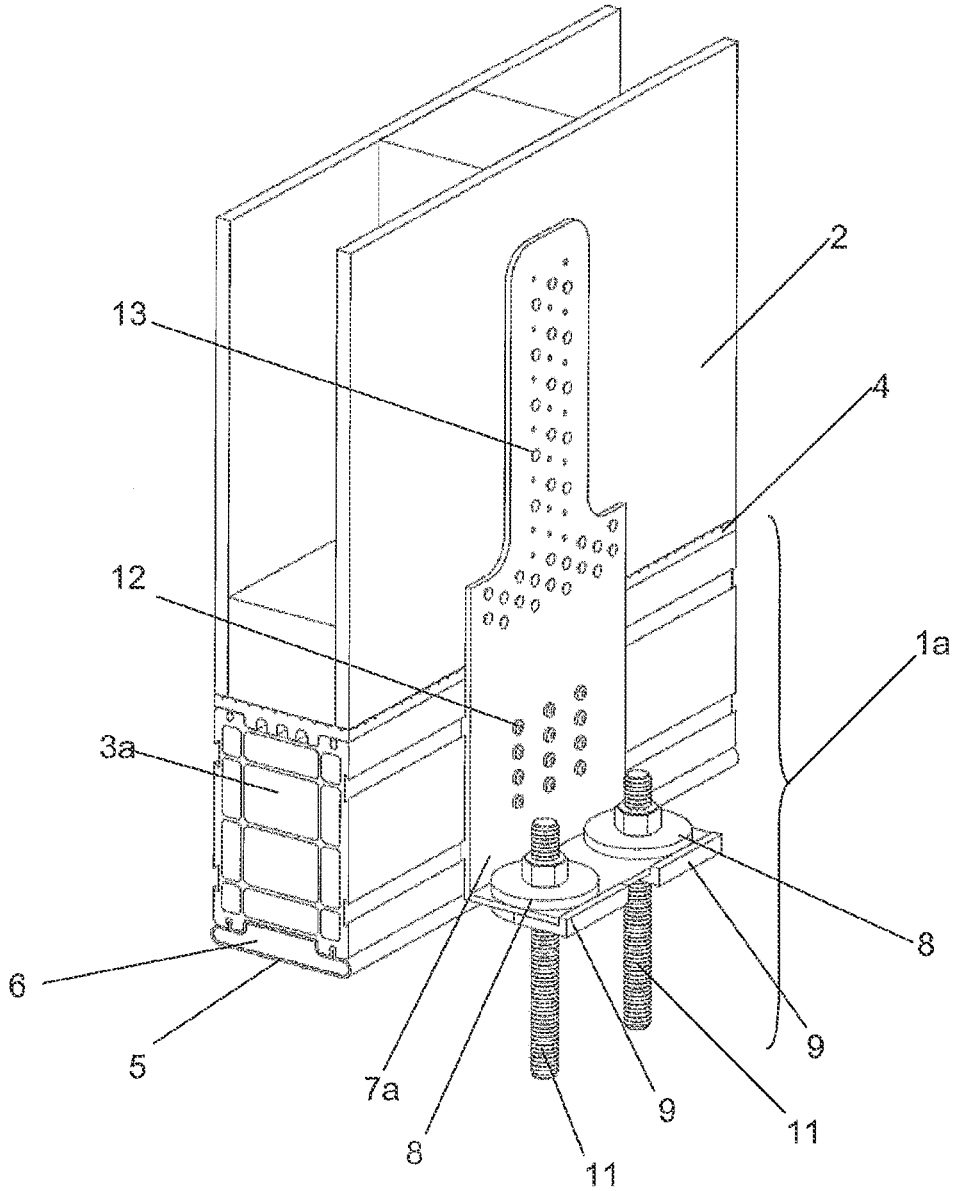
FIG. 4 is an enlarged axonometric view of the building wall base of FIG. 1.
Figure 5:
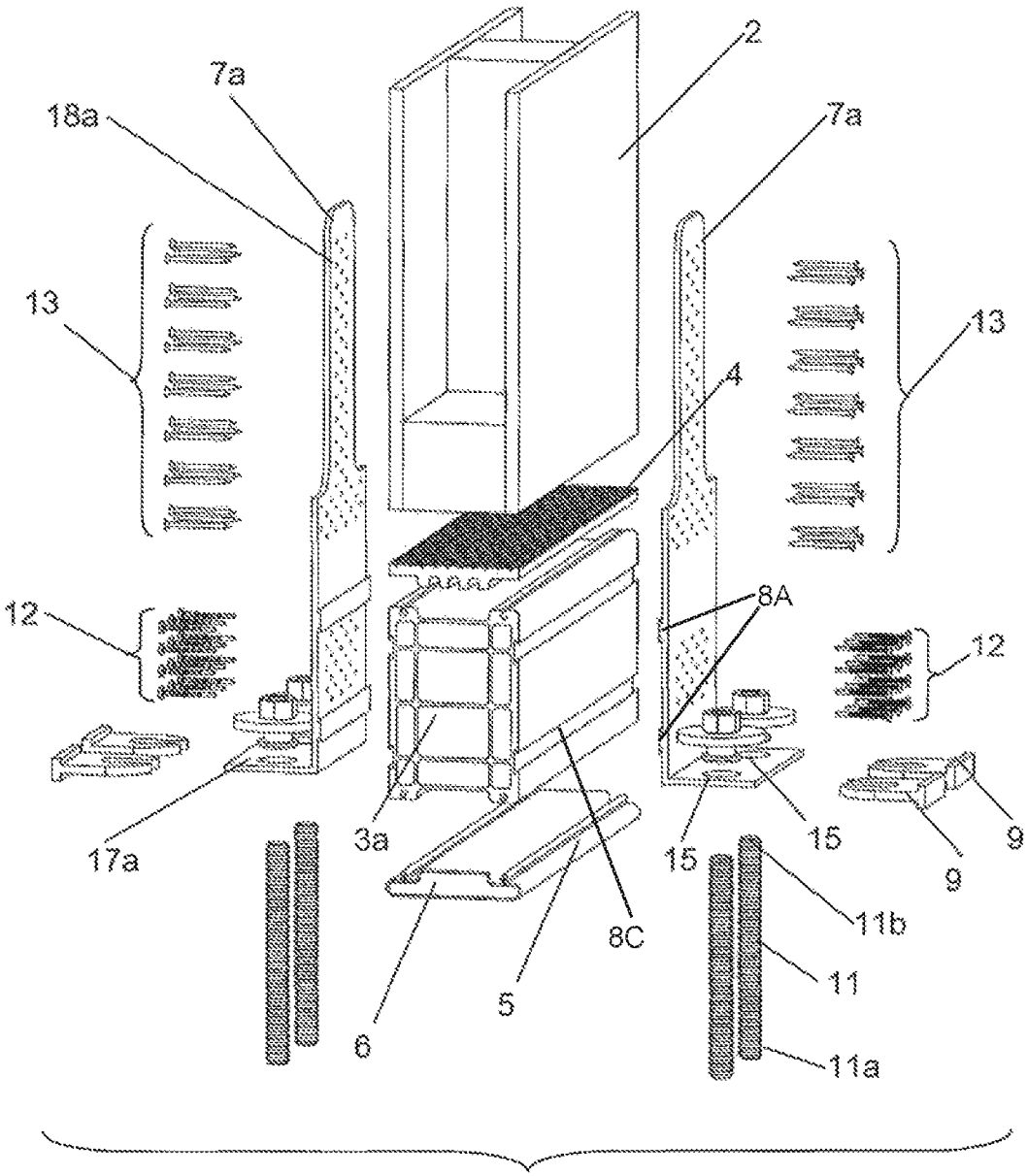
FIG. 5 is an exploded view of the components shown in the view of FIG. 4.

With initial reference to FIGS. 1, 4 and 5, a base 1*a* for a building wall 10*a* comprises a base socle 3*a* susceptible to being interposed, once placed in position, between the panel 2 and the foundation slab.

The base socle 3*a* has a plan width that is equal to or slightly greater than the plan dimensions of the panel 2 and consists of an aluminium extrusion.

According to other embodiments the base socle 3*a* is made of other metal or polymer material and with techniques other than extrusion, for example by moulding or casting.

The base 1*a* further comprises first constraint means to rigidly constrain, in position, the base socle 3*a* to the foundation slab. Said first constraint means are made in such a way as to allow adjustment of the position and orientation of the orientation of the base socle 3*a* with respect to the foundation slab. In particular, the first constraint means allow adjustment of the distance between the base socle 3*a* and the foundation slab as well as the desired planimetric and altimetry alignment of the base socle 3*a* with respect to the foundation slab. To allow said adjustment of the distance the base socle 1*a* further comprises a plurality of angle brackets 7*a*, each of which consists of a first flat plate 17*a*, susceptible to being arranged, in position, almost parallel to the foundation slab, and a second flat plate orthogonally arranged with respect to the first flat plate 17*a*. The base socle 3*a* has horizontal grooves 8C that can engage teeth 8A to hold the angle brackets 7*a* to the base sock 3*a*.

The angle brackets 7*a* are divided into pairs of brackets 7*a* that are opposed with respect to the wall 10*a*. The pairs of brackets 7*a* are regularly distributed along the wall 10*a* so as to ensure that the wall 10*a* is supported in a uniform manner.

The first constraint means comprise the first flat plate 17*a* of the angle bracket 7*a* and for each flat plate 17*a* a pair of threaded couplings usable to adjust, in position, the distance between the base socle 3*a* and the foundation slab Each threaded coupling of the first constraint means comprises a threaded rod 11, susceptible to being constrained, in position, to a first end 11*a* of the foundation slab, and an adjustment bushing 8 susceptible to being constrained, in position, to a second end 11*b* of the threaded rod 11.

During the installation steps, the constraint of the first end 11*a* to the slab is obtained by executing a blind hole in the foundation slab, inserting into said hole the first end 11*a* together with a binder, for example a resin, and waiting for the maturation of the binder.

In position, the threaded rods 11 pass through respective holes 15 provided on the first flat plate 17*a* and the adjustment bushings 8 are screwed onto the second ends 11*b* of the threaded rods 11 in such a way that the respective first flat plate 17*a* is interposed between the foundation slab and the adjustment bushings 8. It is possible to adjust the height and the inclination of each rod 7*a* with respect to the foundation slab by tightening more or less the adjustment bushings 8 on the threaded road 11. The holes 15 are preferably slotted so as to advantageously allow adjustment of the planimetric position and thus of the alignment of the walls.

The first constraint means further comprise, for each threaded rod 11, a respective quick-connect fastening cotter pin 9 of suitable thickness interposed between the respective first flat plate 17*a* and the foundation slab and in contact with these. The quick connection is guaranteed in that each fastening cotter pin 9 comprises a hole 16, susceptible to being crossed by a respective threaded bar 11, that is laterally opened by means of a notch 19, which allows insertion or removal of the fastening cotter pin 9 even when the respective bracket 7*a*, threaded rod 11 and adjustment bushing 8 have already been implemented.

The base 1*a* further comprises a first tubular member 5 that is filled with a mixture 6 consisting for example of a cement grout, or other suitable material such as high density polyurethane foam or another material still. The tubular member 5 susceptible to being interposed, in position, between the base socle 3*a* and the foundation slab to fill the air space remaining between the base socle 3*a* and foundation after fastening of the base 1*a*, by means of the first constraint means, has taken place. On maturation of the mixture 6, the tubular member 5 offsets foundation slab irregularities and efficiently transmits the loads of the wall 1*a*. Furthermore, the tubular member 5 also carries out the separating and thermal cutting function between the foundation and the base socle 3*a*.

The presence of the tubular member 5 filled with cement grout is optional, being absent in some embodiments of the present invention. According to these latter variant embodiments (not shown as they are not the object of the invention), the tubular member 5 is replaced by other functionally similar members obtained by traditional techniques, for example by pouring the cement grout into the lateral containment formwork beneath the base socle 3*a* or by cement mortar reinforcement beneath the base socle 3*a*.

The base 1*a* further comprises an insulating layer 4 having a thermal cutting function, susceptible to being interposed, in position, between the panel 2 and the base socle 3*a*, so as to thermally insulate the wall 2 from the base socle 3*a*.

The presence of the thermally insulating layer 4 is optional, being absent in some embodiments of the present invention.

The wall 2 rests on the thermally insulating layer 4 or directly on the base socle 3*a*. To rigidly constrain, in position, the panel 2 to the base socle 3*a*, the base 1*a* comprises second constraint means, consisting of the second plate 18*a* of the angle bracket 7*a*, of a plurality of screws 12 to be constrained to each other, in position, the second plate 18*a* and the base socle 3*a* and of a plurality of nails 13 to constrain between them the second flat plate 18*a* and the panel 2, when the panel 2 is made of wood. Where the panel 2 is made of another material the plurality of nails 13 may be conveniently replaced by a plurality of screws.

Figure 2:
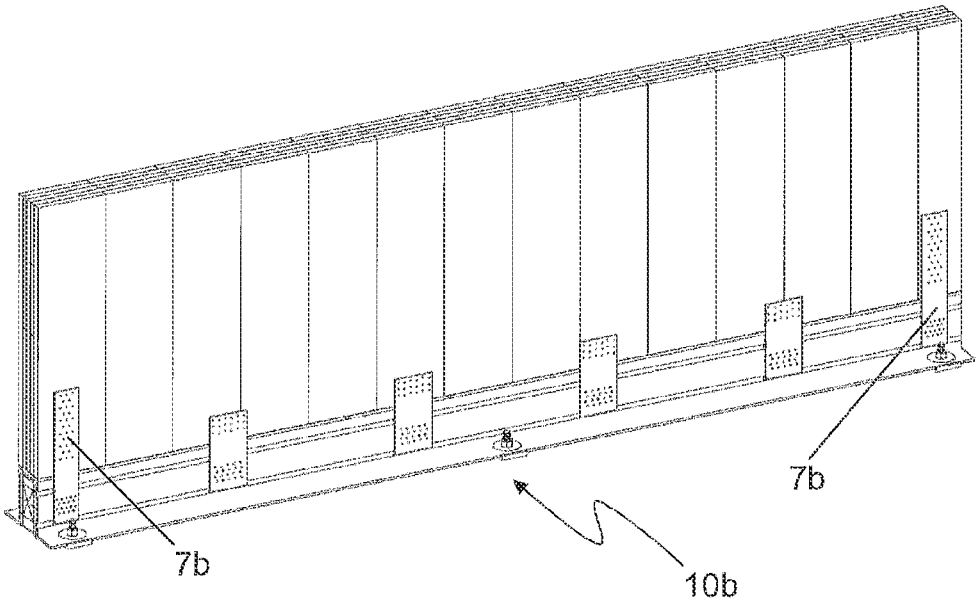
FIG. 2 is an axonometric view of a variant embodiment of the wall of FIG. 1.
Figure 6:
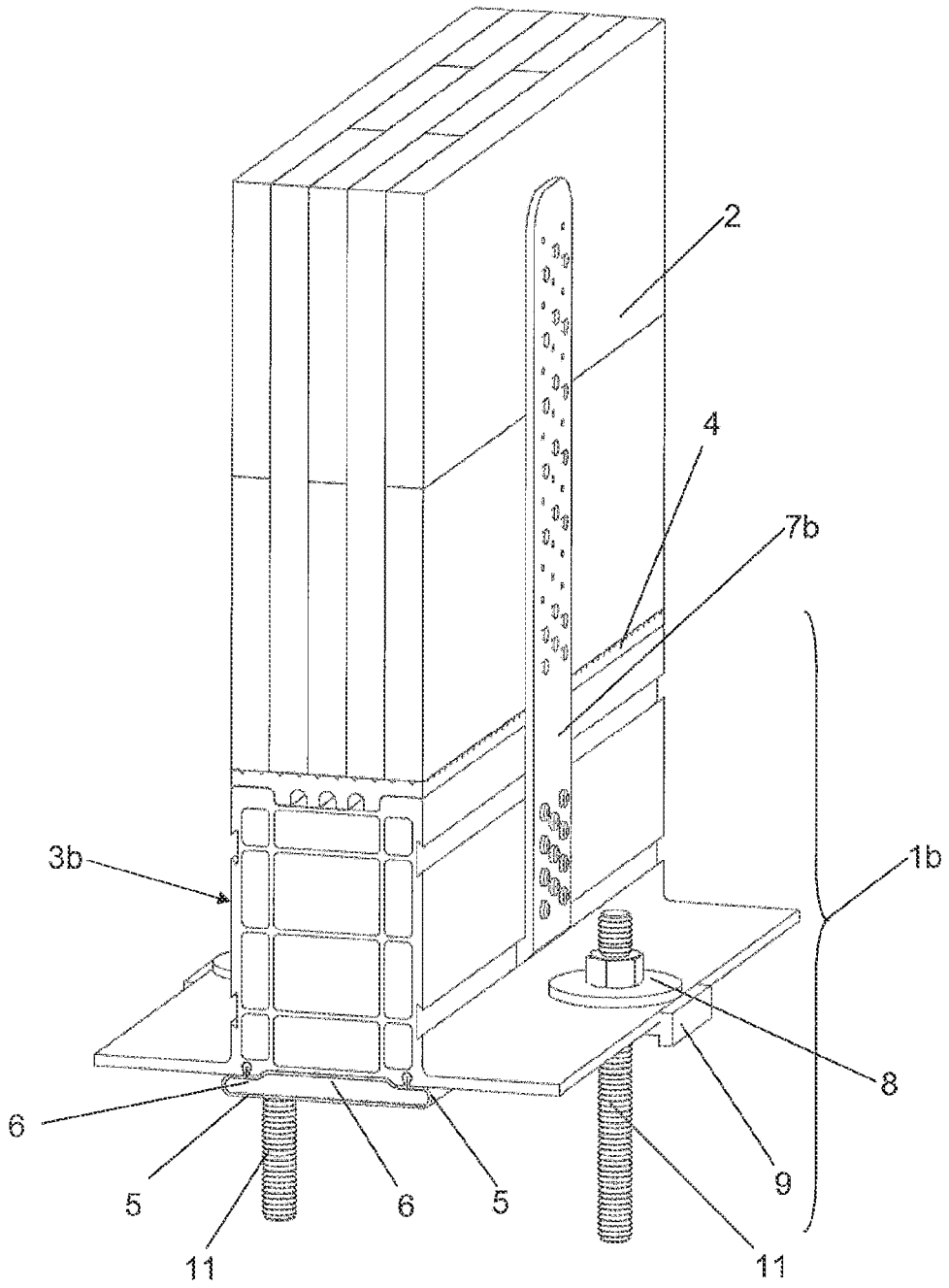
FIG. 6 is an enlarged axonometric view of the building wall base of FIG. 2.
Figure 7:
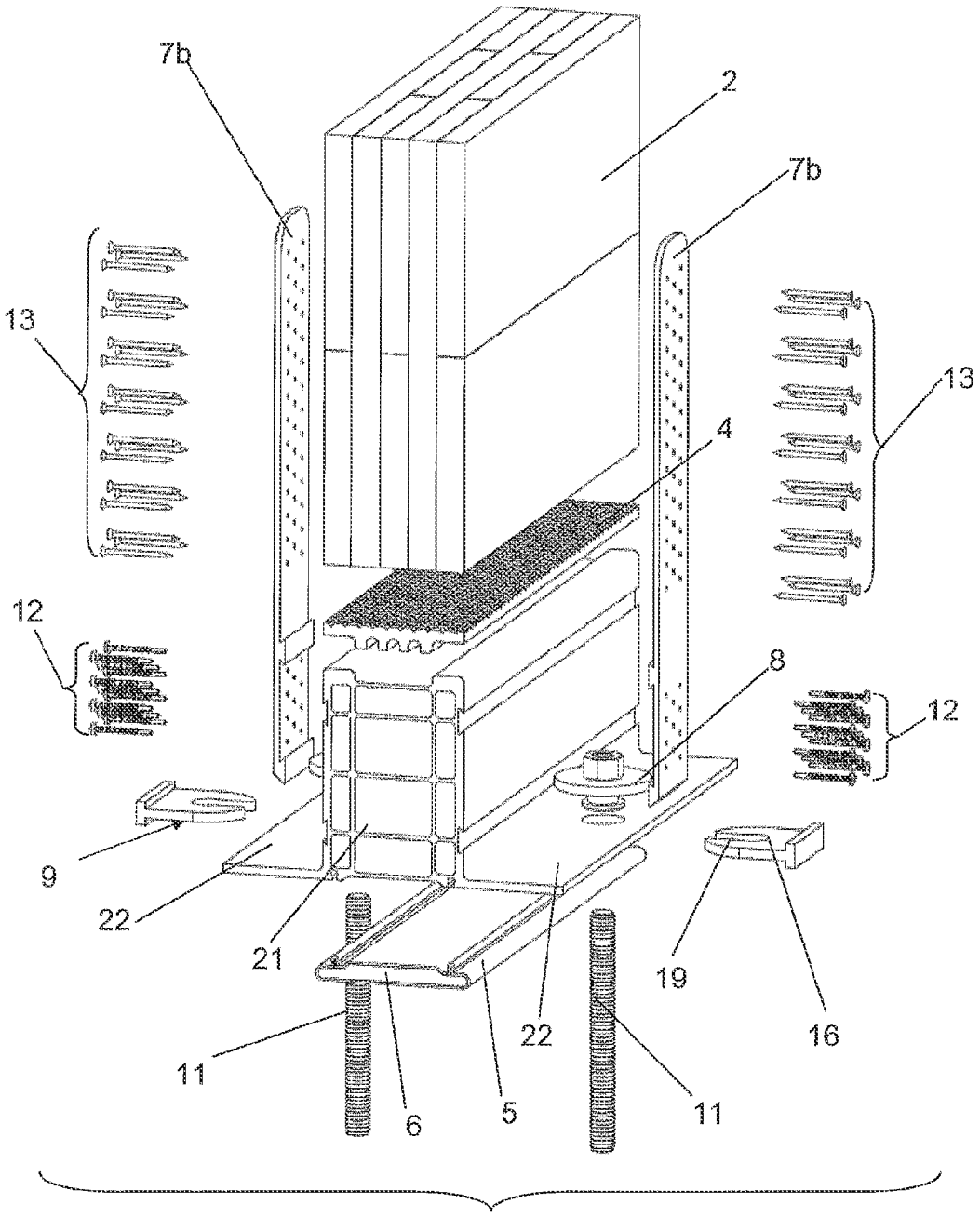
FIG. 7 is an exploded view of the components shown in the view of FIG. 6.

With reference to the variant of FIGS. 2, 6 and 7, the base 1*b* for the building wall 10*b* does not include, in respect to the first variant, the angle bracket 7*a*, since it instead comprises a base socle 3*b* having a central body 21 and a pair of wings 22 symmetrically arranges with respect to the central body 21. The pair of wings 22 are susceptible to being rigidly connected, in position, to the foundation slab, by means of said first constraint means, in an entirely analogous way as seen for the constraining of said first plate 17*a* to the foundation slab. The central body 21 is susceptible to being rigidly constrained, in position, to the panel 2 by means of the second constraint means, which, in this variant embodiment comprise, in addition to the plurality of screws 12 and of nails 13, a flat bracket 7*b* that is analogous in terms of structure and function, to the second flat plate 18*a* of the angle bracket 7*a*. The flat bracket 7*b* is thus rigidly constrainable, in position, to the central body 21, by means of the plurality of screws 12, and to the wooden panel 2, by means of the plurality of nails 13.

Figure 3:
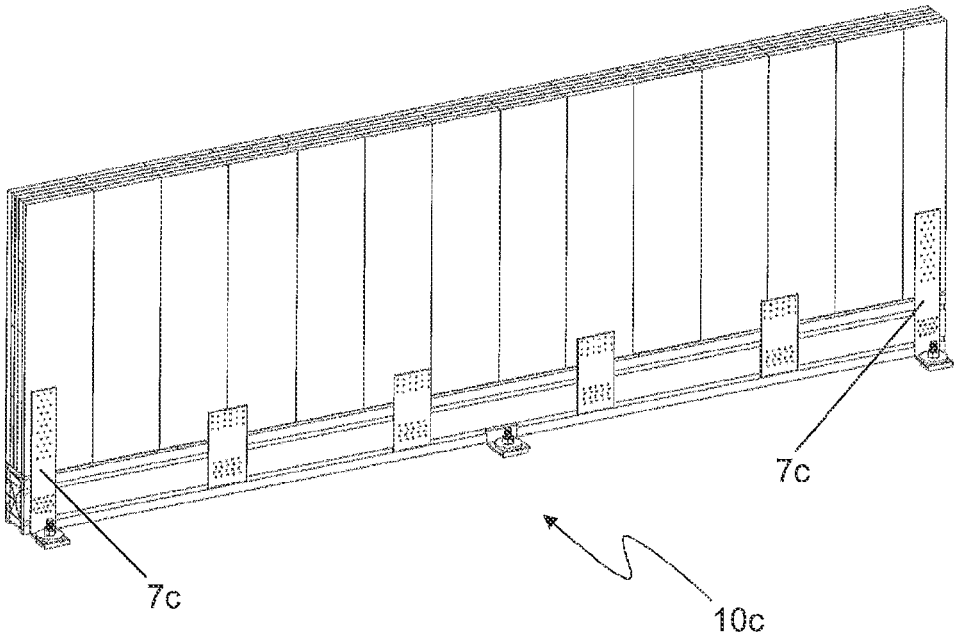
FIG. 3 is an axonometric view of a further variant embodiment of the wall of FIG. 1.
Figure 8:
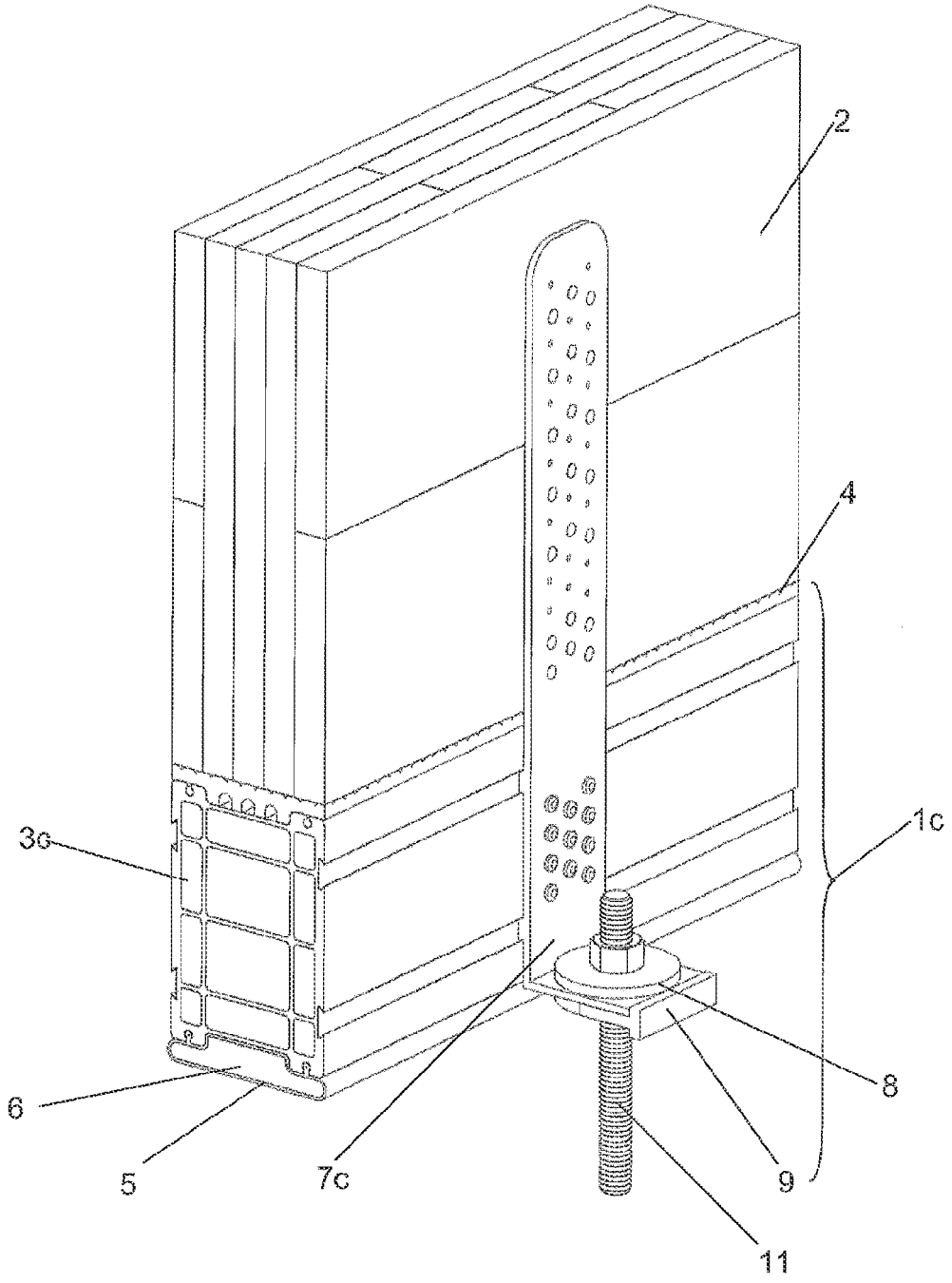
FIG. 8 is an enlarged axonometric view of the building wall base of FIG. 3.
Figure 9:
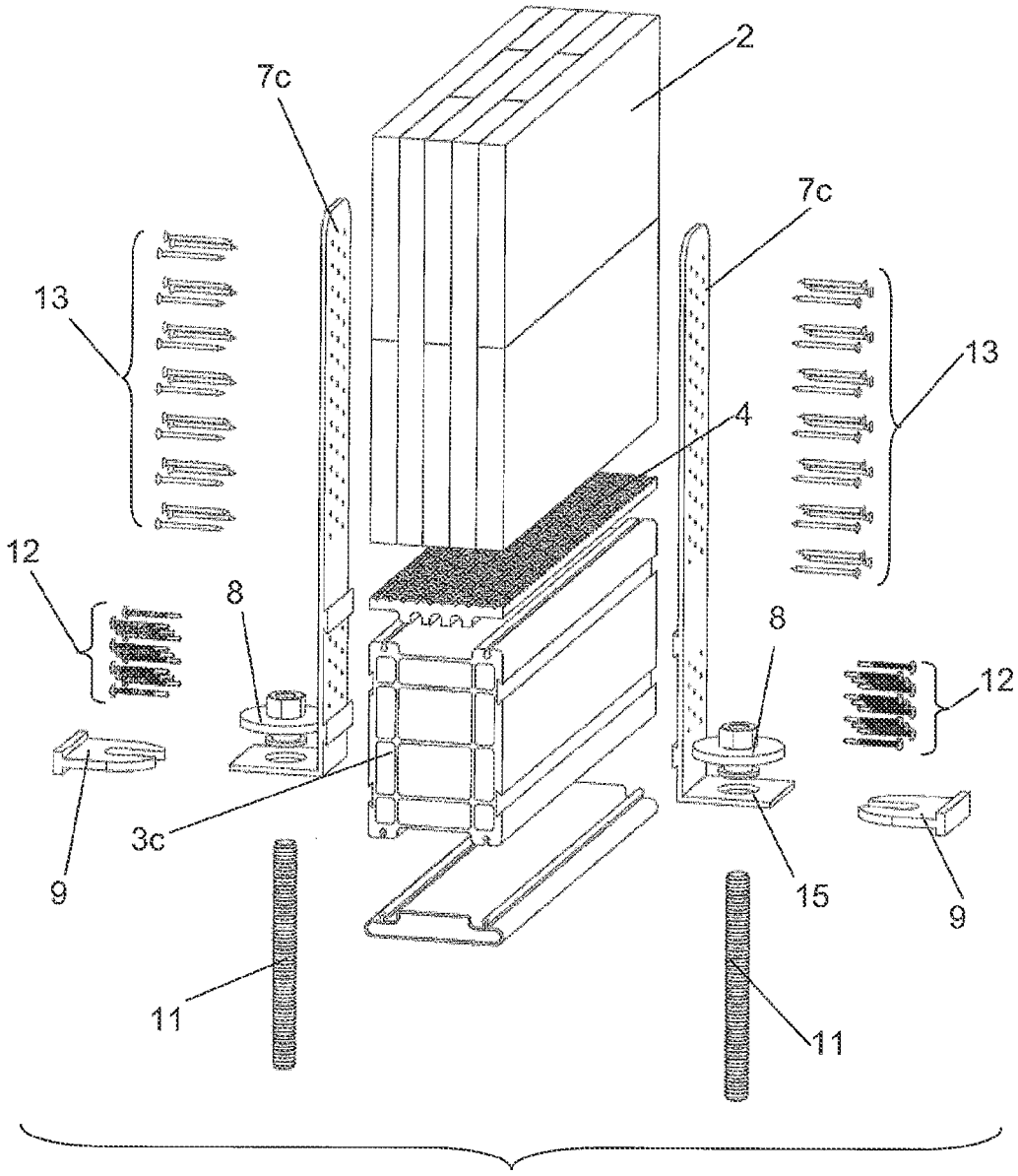
FIG. 9 is an exploded view of the components shown in the view of FIG. 8.

With reference to the variant of FIGS. 3, 8 and 9, the base 1*c* for the building wall 10*c* differs from the base 1*a* in that the respective angle bracket 7*c* comprises a single hole 15 for a single threaded coupling consequently consisting of a single threaded rod 11 and of a single adjustment bushing 8. A single quick-connect fastening cotter pin fixing 9 is consequently also envisaged.

According to the present invention, the construction of a building comprising at least one building wall 10*a*, 10*b*, 10*c*, in a variant embodiment wherein both the grout-filled tubular member 5 and the thermally insulating layer 4 are present is achieved by means of a method that includes the following steps:

- preparing a foundation slab in reinforced concrete,
- placing a hollow, tubular member 5 onto the foundation slab,
- placing a base 3*a*, 3*b*, 3*c* onto said tubular member 5 and constraining the base socle 3*a*, 3*b*, 3*c* to the foundation slab by means of first constraint means 7*a*, 7*c*, 8, 9, 11, as described above,
- adjusting the position and inclination of the base socle 3*a*, 3*b*, 3*c* with respect to the foundation slab, in particular the position and planimetric and altimetry alignment of the base socle 3*a*, 3*b*, 3*c*, by means of the first constraint means 7*a*, 7*c*, 8, 9, 11, as described above,
- placing a thermally insulating layer 4 onto the base socle 3*a*, 3*b*, 3*c*,
- placing a panel 2 onto the thermally insulating layer 4,
- rigidly constraining the panel 2 to said base socle 3*a*, 3*b*, 3*c* by means of second constraint means 7*a*, 7*b*, 7*c*, 12, 13, as described above,
- filling the tubular member 5 with a mixture 6 including grout, cement or other binder, and waiting for the maturation thereof.

Where the tubular member 5 and/or the insulating layer 4 should not be present, the respective method steps are omitted The presence of the base socle 3*a*, 3*b*, 3*c* allows the following:

- raising of the wall 1*a*, 1*b*, 1*c* with respect to the foundation slab;
- forming of a rectilinear base beam and at a height thanks to the possibility of adjusting ensured by the first connecting means,
- preventing water and dampness to rise towards the wall 2,
- supporting the vertical and horizontal loads arising from the overlying elevated structure. Said aspect is further improved where the tubular member 5 filled with grout 6 is used,
- effectively connecting the overlying structure to the foundation so as to prevent any lifting and sliding actins,
- increasing the thermal insulation where the insulating layer 4 and/or the tubular member 5 are used.

The present invention thus allows the aims proposed in reference to the aforementioned prior art to be achieved, while at the same time achieving further advantages, such as improving the durability of the construction and reducing the thermal bridge at the base of the building.

The invention claimed is:

1. A base for a building wall comprising:

- a base socle provided with horizontal grooves and susceptible to being interposed, in position, between a panel of said building wall and a foundation slab,
- a first adjustable constraint means that are adapted to rigidly constrain, in position, said base socle to said foundation slab, said first constraint means comprising threaded means,
- a flat plate arranged substantial' parallel to the foundation slab and provided with a hole adapted to receive the threaded means, and
- a second plate angularly arranged with respect to said flat plate and provided with teeth adapted to be housed in said horizontal grooves,
- whereby said first constraint means allow adjustment of the position and inclination of said base socle with respect to said foundation slab,
- a second constraint means to rigidly constrain, in position, said panel to said base socle wherein said base further comprises a tubular member filled with a mixture and susceptible to being interposed, in position, between said base socle and said foundation slab.

2. The base for a building wall according to claim 1, wherein said base further comprises a thermally insulating layer susceptible to being interposed, in position, between said panel and said base socle.

3. The base for a building wall according to claim 1, wherein said base further comprises at least one angle bracket, said one angle bracket comprising said flat plate and a second plate, wherein said second plate is angularly arranged with respect to said flat plate a id is provided with said teeth said second plate being rigidly constrainable, in position, to said panel and to said base socle.

4. The base for a building wall according to claim 3, wherein said second constraint means comprise:

a first plurality of nails or screws to constrain together, in position, said second plate and said base socle, a second plurality of nails or screws to constrain together, position, said second plate and said panel.

5. The base (1*b*) for a building wall according to claim 1, wherein said base socle comprises a central body and a pair of wings, symmetrically arranged with respect to said central body, wherein the flat plate consists of one of said wings, said central body being susceptible to being rigidly constrained, in position, to said panel by means of said second constraint means.

6. The base for a building wall according to claim 5, wherein said second constraint means comprise a flat bracket that is rigidly constrainable, in position, to said central body, by means of a first plurality of nails or screws, and to said panel, by means of a second plurality of nails or screws.

7. The base for a building wall according to claim 1, wherein said base socle consists of an aluminum extrusion.

8. The building wall comprising a panel and a base (1*a*, 1*b*, 1*c*), according to claim 1, to connect said panel to a foundation slab.

9. The building wall comprising a panel and a base according to claim 3 to connect said panel to a foundation slab.

10. The building wall comprising a panel and a base according to claim 5 to connect said panel to a foundation slab.

11. The building wall according to claim 8, wherein said panel is a light panel made of wood or aluminum or steel.

12. A building construction method comprising the steps of:

preparing a reinforced concrete foundation slab, placing a hollow, tubular member onto said foundation slab, placing a base socle having horizontal grooves onto said tubular member and constraining said base socle to said foundation slab by means of a first constraint means, adjusting the position of the base socle with respect to said foundation slab by means of said first constraint means comprising threaded means, a flat plate arranged substantially parallel to the foundation slab and provided with a hole adapted to receive the threaded means and a second plate angularly arranged with respect to said flat plate and provided with teeth adapted to be housed in said horizontal grooves, placing a thermally insulating layer onto said base socle, placing a panel onto said thermally insulating layer, rigidly constraining said panel to said base socle by means of a second constraint means, filling said tubular member with a mixture.

13. The base for a building wall according to claim 2, wherein said base socle comprises a central body and a pair of wings, symmetrically arranged with respect to said central body, wherein the flat plate consists of one of said wings, said central body being susceptible to being rigidly constrained, in position, to said second constraint means.

14. The building wall comprising a panel and a base, according to claim 2, to connect said panel to a foundation slab.

15. The base for a building wall according to claim 2, wherein said base further comprises at least one angle bracket, said one angle bracket comprising said flat plate and said second plate, wherein said second plate is angularly arranged with respect to said flat plate and is provided with said teeth, said second plate being rigidly constrainabie, in position, to said panel and to said base socle.

* * * * *